United States Patent [19]

Wilson

[11] 4,269,448

[45] May 26, 1981

[54] MINERAL MINING MACHINE CUTTER DRIVING MECHANISM HAVING A LOAD SENSING DEVICE TO REGULATE THE HAULAGE SPEED OF THE MACHINE WHEN THE CUTTER DRIVING MECHANISM IS OVERLOADED

[75] Inventor: Samuel L. Wilson, Wishaw, Scotland

[73] Assignee: Anderson Strathclyde Limited, Glasgow, Scotland

[21] Appl. No.: 47,915

[22] Filed: Jun. 12, 1979

Related U.S. Application Data

[63] Continuation of Ser. No. 850,305, Nov. 10, 1977, abandoned.

[30] Foreign Application Priority Data

Nov. 11, 1976 [GB] United Kingdom ..... 47099/76

[51] Int. Cl.[3] ..... E21C 29/02

[52] U.S. Cl. ..... 299/1; 173/7; 318/39

[58] Field of Search ..... 299/1; 318/39; 173/5, 173/7, 9; 73/136 B

[56] References Cited

U.S. PATENT DOCUMENTS

| | | | |
|---|---|---|---|
| 3,323,839 | 6/1967 | Addison et al. | 299/1 |
| 3,400,768 | 9/1968 | Kuiders et al. | 173/7 |
| 3,489,461 | 1/1970 | Lauber | 299/1 |
| 3,633,081 | 1/1972 | Weber et al. | 299/1 X |
| 3,988,578 | 10/1976 | Weber | 299/1 X |

*Primary Examiner*—William F. Pate, III

[57] ABSTRACT

A mineral mining machine having haulage drive mechanism and at least one cutter drive unit for cutting elements which may be at each end of the mining machine. The cutting elements are driven by an electric motor through a variable speed gear-train and the haulage mechanism is driven by a hydraulic motor through a gear-train. The invention provides for a torque sensing device associated with a part of each cutter drive mechanism to sense the power transmitted by the cutter gear-train and a power sensing device associated with the electric motor. The torque sensing devices are in the form of a mechanical or electrical transducer which provides a signal when the power transmitted by the cutter gear-trains exceed or tends to exceed the rated value of the cutter gears. The signal is transmitted to a hydraulic pump to control the output to the hydraulic motor and thereby effect reduction of the haulage speed. A signal from the power sensing device also controls the hydraulic pump to effect reduction of the haulage speed.

7 Claims, 3 Drawing Figures

MINERAL MINING MACHINE CUTTER DRIVING MECHANISM HAVING A LOAD SENSING DEVICE TO REGULATE THE HAULAGE SPEED OF THE MACHINE WHEN THE CUTTER DRIVING MECHANISM IS OVERLOADED

RELATED APPLICATION

This application is a continuation of Applicant's pending Application Ser. No. 850,305, filed Nov. 10, 1977, now abandoned, for which all rights are claimed.

This invention relates to mineral mining machine cutter driving mechanism having a load sensing device and a torque sensing device operable to regulate the haulage speed of the machine when the cutter driving mechanism is overloaded.

An electric motor is normally provided to supply power through a gear-train to the cutting elements of a mineral mining machine, the machine being hauled or driven along a mineral face or into a face by haulage mechanism. The load on the cutting elements when cutting a given material at a given speed and thus the load on the gear-train is proportional to the haulage speed of the machine.

Where a variable speed gearbox is used in the gear-train for the cutting elements the power provided by the electric motor may be far in excess of the torque rating of part of the gear-train when the cutting elements are running at low speed and this could result in serious mechanical damage to the gears.

It is desirable for some mining operations, such as cleaning up or cutting into hard stone, to rotate the cutting elements at relatively slow speed. It is often impractical to design the cutter drive gearbox to be capable of transmitting the full rated horse power of the driving motor at these low speeds since this would require the physical dimensions of the gearbox to be greatly increased and it is advantageous and sometimes necessary to keep these dimensions to a minimum.

In double ended mineral mining machines having cutting elements located at each end of the machine it is known to incorporate two electric motors in order to provide the power required for the cutting operations.

In such applications the electric motor driving the leading cutting element may be running under overload conditions while the motor driving the trailing cutting elements may be relatively unloaded.

It is desirable that the electrical load should be shared approximately equally between the two motors and this can be achieved by providing a mechanical link between the two motors.

This arrangement could result in providing power to the leading cutter drive gear-train far in excess of its rated horsepower which could result in serious mechanical damage to the gears.

The haulage drive mechanism includes a hydraulic pump of variable output which is actuated by an electric motor to supply varying quantities of working fluid to the hydraulic motor to drive the haulage mechanism through a haulage gear-train. The haulage drive mechanism may include automatic load control mechanism (not shown) which is responsive to overload on the haulage drive mechanism and does not form part of this invention.

The present invention provides for a load sensing device responsive to the current flow to the electric motor driving the cutting elements said sensing device being operatively connected, through a servo device, to a pilot valve to actuate a control cylinder connected to the pump in accordance with changes in the current load on the electric motor.

The present invention also provides for a mechanical or electrical torque sensing device fitted to the or each cutter drive gearbox which senses thr torque being transmitted by a particular part of any of the cutter drive gear-train and when the torque exceeds or tends to exceed the torque rated value of the cutter gears a signal from the torque sensing device is transmitted to the haulage drive mechanism to reduce the haulage speed of the machine until the torque transmitted by the cutters drops to within an acceptable limit to avoid damage to the gears.

The haulage drive mechanism is preferably hydraulically operated and of the infinitely variable type so that it may be varied in response to a signal from the torque sensing device to decrease the feed or haulage rate of the machine if the torque transmitted by the cutter gear tends to exceed the rated power value of the gearbox at lower cutting speeds.

So long as the torque being transmitted by the gear-train for the cutting element or elements remained below the rated value of the gear-train the feed or haulage speed would not be affected by the torque sensing device.

According to the invention a mineral mining machine having haulage drive mechanism and at least one cutter drive unit, the or each cutter drive unit including a gear-train having variable speed mechanism driving cutting elements, in which a torque sensing device is associated with the or each cutter drive unit to sense the torque transmitted by the gear-train and to provide a signal to the machine haulage drive mechanism to reduce the haulage speed when the gear-train or gear-trains is or are being overloaded.

Preferred embodiments of the invention are illustrated by way of example in the accompanying drawings in which.

Figure 1:
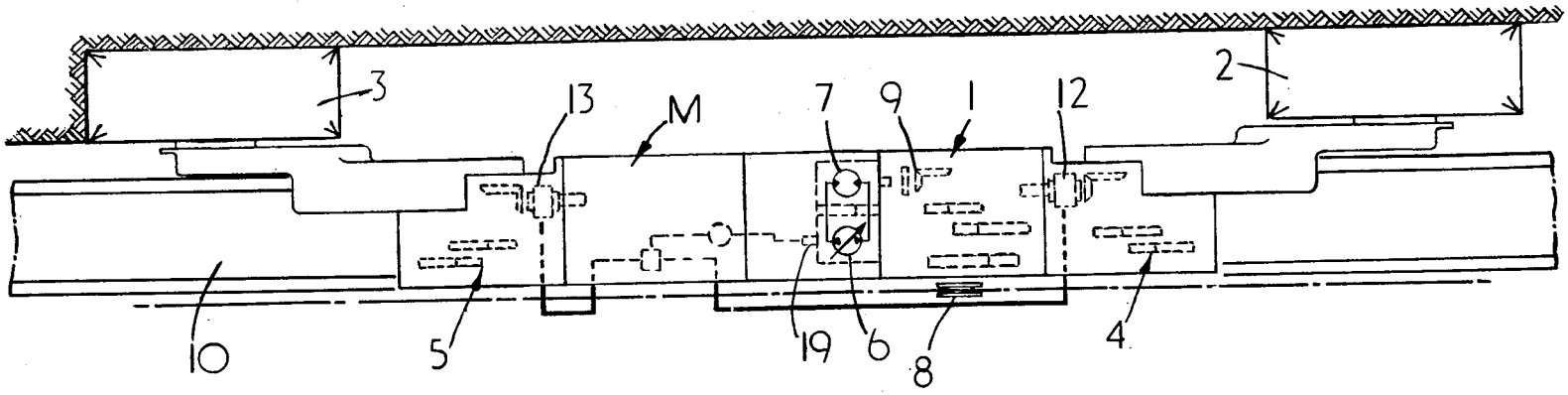
FIG. 1 is a schematic illustration of a mineral mining machine having load and torque sensing devices according to the invention.

Referring to FIG. 1 of the drawings a double ended mineral mining machine is denoted generally at 1 which has cutting elements 2 and 3 at each end thereof. Each of the cutting elements 2 and 3 have respective variable speed gear-trains 4 and 5 operatively connected to an electric motor M to drive the cutting elements. The gear trains 4 and 5 may include an epicyclic gear.

A hydraulic pump 6 driven by the electric motor supplies working fluid to a hydraulic motor 7 which drives haulage mechanism 8 through a gear-train 9. The haulage mechanism 8 drives the mining machine across a mineral face along a conveyor 10.

Torque sensing devices 12 and 13 are operatively associated with their respective gear-trains 4 and 5 to sense the load transmitted by part of their respective cutter gear-train and if the load exceeds or tends to exceed the load rated value of that part of the cutter gear-train a signal from the torque sensing device or devices is transmitted to the hydraulic pump for the haulage mechanism to reduce the haulage speed of the machine until the load transmitted by the cutters drops to within an acceptable limit to avoid damage to the cutter gear-trains.

The torque sensing devices 12 and 13 are torque transducers which may provide an electrical or mechanical signal to a servo device operatively associated with a control cylinder for the hydraulic pump 6.

Figure 2:
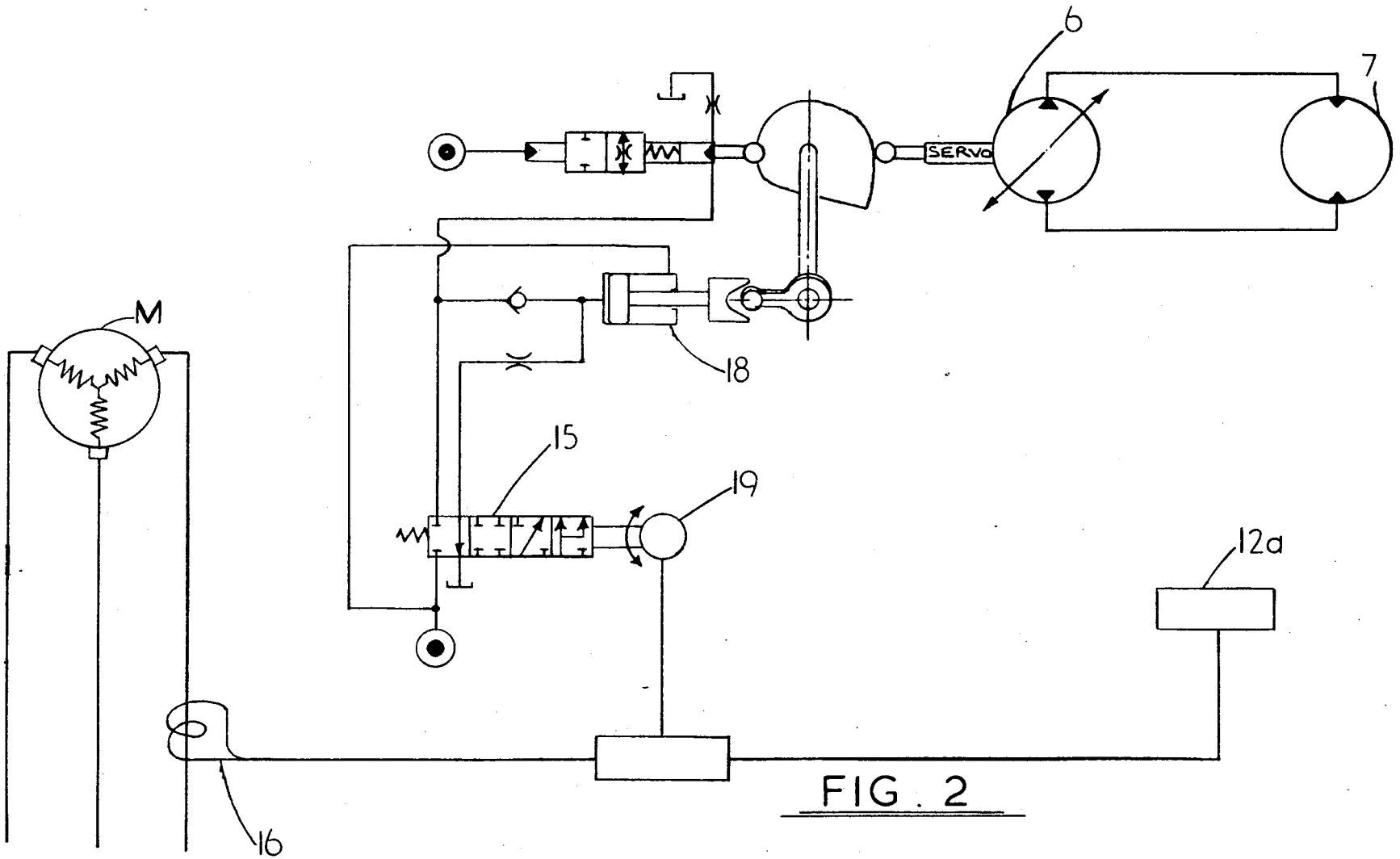
FIG. 2 is a schematic illustration of a hydraulic circuit for the load and torque sensing devices according to one embodiment of the invention.

Referring to FIG. 2 of the drawings a pilot valve 15 operatively connected to a power sensing device 16 itself responsive to the current flow to the electric motor M, is operative to actuate a control cylinder 18 which controls working fluid flow from the pump 6 to the motor 7. The control cylinder 18 thus controls the hydraulic motor 7 in accordance with the current load on the electric motor.

The power sensing device 16 which is in the form of an inductive winding associated with the motor M responds to current through the motor M, i.e. it is responsive to the load on the haulage mechanism and the cutters combined and actuates a servo device 19 to reduce haulage speed and hence cutter power consumption. However, the power consumed by the haulage mechanism 8, even in terms of its overload, is so low in relation to that of the cutters 2 and 3 that the power sensing device 16 must be discounted for effective control of overload on the haulage mechanism which is taken care of independently by a separate automatic load control mechanism (not shown) which does not form part of the present invention.

Referring to the embodiment illustrated in FIG. 2 the torque sensing devices 12 and 13 are illustrated at 12*a* as torque transducers which are connected to a part of their respective cutter gear-trains 4 and 5 to sense the torque transmitted by that part of the gear-train and to provide an electrical signal through the gate G to the servo device 19. The gate G is capable of accepting signals from the power sensing device 16 and the torque sensing devices 12*a* and relaying a resultant signal to the servo device 19 to actuate the hydraulic pump 6 to reduce the haulage speed.

Figure 3:
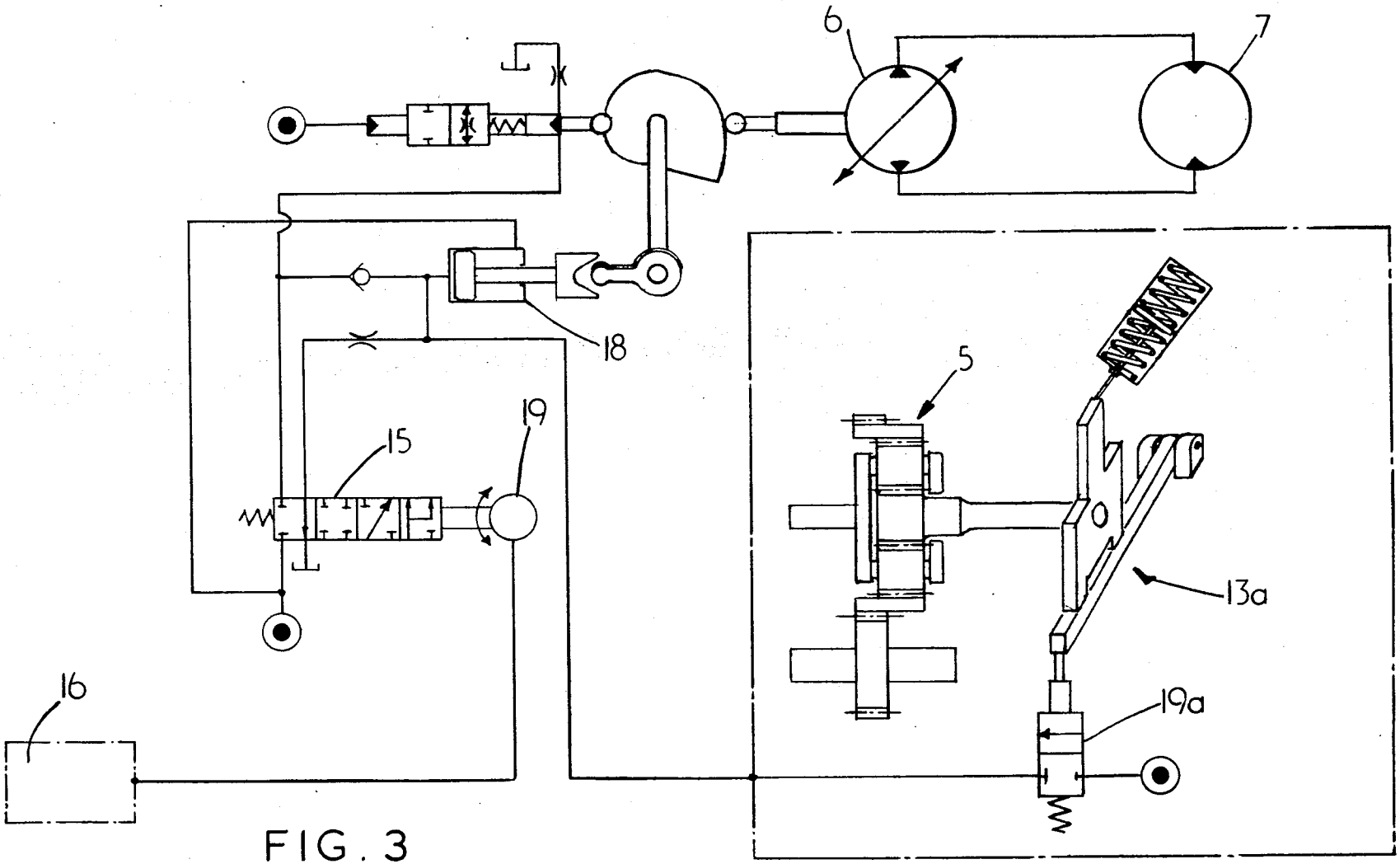
FIG. 3 is a schematic illustration of a hydraulic circuit similar to that of FIG. 2 incorporating a torque sensing device according to another embodiment of the invention.

An alternative embodiment of torque sensing devices is illustrated in FIG. 3 in which the torque sensing devices are illustrated generally at 13*a* as mechanical devices.

In this embodiment the cutter gear-trains 4 and 5 each include an epicyclic gear and the mechanical torque sensing device 13*a* is operatively associated with the sun gear of the epicyclic gear to provide a hydro-mechanical signal to actuate the control cylinder 18. The sensing device 13*a* comprises spring loaded mechanism, indicated generally at S which, by virtue of the spring, holds against the reactive torque of the sun gear to transmit the drive. When a selected limiting torque is reached the spring resistance is overcome and in so doing the lever L is actuated to move a two position valve 19*a* and allow fluid from a constant pressure source to be fed into the control cylinder 18, by-passing the servo device 19, to reduce the haulage speed irrespective of the position of the valve 15 and irrespective of any signal from the power sensing device 16. As the power sensing device 16 and the torque sensing devices 13*a* do not have a common input signal the gate G of the FIG. 2 construction is omitted.

In operation with the electric motor M running, haulage movement begins by manually rotating a cam C (FIGS. 2 and 3) to bring the control cylinder 18 into a position to provide maximum delivery of the pump 6 to the motor 7. In this condition, the servo 19, in the absence of signals from any of the sensing devices 16,12 or 13, brings the valve 15 into a first position in which it will steadily increase the haulage speed until the power absorved by the cutters 2 and 3 reaches a predetermined percentage of the full load on the motor M which may be in the order of 85% of full load, and provided no overriding signal is received from the torque sensing devices Above this predetermined level of full load on the Motor M a signal will be provided by the power sensing device 16 which causes the servo device 19 to move the valve 15 into a second position to lock the control cylinder 18 against further movement thus preventing the haulage speed from increasing.

At a predetermined level of overload on the motor M the the increasing signal from the power sensing device 16 causes the servo device 19 to move the valve 15 into a third position which allows pressure oil into both sides of the piston of control cylinder 18 whereby, because of the difference between full and annular areas, the piston will begin to move to rotate the cam C and reduce delivery of the pump 6 to the motor 7 and thus the haulage speed will be reduced until the power consumption of the motor M reduces to or below the predetermined acceptable overload level. At this stage the pump 6 will cycle under signal control from the power sensing device 16 to keep the haulage speed commensurate within the acceptable motor overload.

When the motor M overloads in excess of the acceptable overload due to obstruction being encountered by the cutters the power sensing device 16 causes the servo device 19 to move the valve 15 into a fourth position which passes the pressure source oil to tank through a control orifice, the resulting back pressure causes the control cylinder 18 to reduce pump output as before but at the same time activates a valve V to allow the pump to circulate its oil within a closed loop and the motor 7 stops.

So far only signals from the electric motor M and sensing device 16 have been discussed but obviously similar signals from the torque sensing devices 12,13 will have the same control over the pump and thus the motor 7, the fineness of control being decided by the response figure at which the signal will start.

Where all the signals from the sensing devices 16,12 and 13 are electrical as in the FIG. 2 embodiment they are effectively overlaid on each other through the gate G, and the servo 19 activation is triggered by whichever signal is the greater.

Although the invention has been described with reference to a double ended mining machine incorporating automatic power control mechanism of the electric motor the invention is not so limited as it is equally applicable to a single ended mining machine or a double ended mining machine with or without automatic load control mechanism for the electric motor the torque sensing device or devices of the present invention being applicable to the cutter gear-train.

What is claimed is:

1. A mineral mining machine having an electric motor, at least one cutter unit and haulage drive mechanism for moving the machine along a mineral face, said cutter unit including a cutter element and a variable speed gear-train interposed between said electric motor and said cutter element to drive said cutter element, torque sensing means associated with part of said cutter gear-train to sense the torque transmitted by said gear-train and to provide a signal when the torque transmitted by said gear-train exceeds a predetermined level, load sensing means associated with said electric motor responsive to current flow through said electric motor to provide a signal, said haulage mechanism having an hydraulic motor, a source of hydraulic fluid, a variable output pump for feeding said hydraulic fluid to said motor, and control means in an hydraulic circuit responsive to said signals from the torque and load sensing means to control the hydraulic pump output and thereby effect reduction of the haulage speed.

2. A mineral mining machine according to claim 1 wherein the control means includes a servo device, valve means in said hydraulic circuit actuated by said servo device and a control cylinder associated with said valve means and operative to actuate cam means to control said pump output.

3. A mineral mining machine according to claim 2 wherein said torque sensing device comprises a torque transducer responsive to a predetermined overload on part of said cutter gear-train to provide an electrical signal and said load sensing device comprises an inductive winding, the signals from said torque sensing device and said load sensing device being fed through a gate to provide a resultant signal to said servo device to effect reduction of haulage drive speed.

4. A mineral mining machine according to claim 2 wherein said cutter gear-train includes an epicyclic gear, said torque sensing device comprises mechanical torque sensing means which includes spring loaded mechanism associated with the epicyclic gear to actuate a lever to provide a mechanical signal to a valve which allows fluid to flow from a constant pressure source to a cylinder to provide a hydraulic signal to actuate said control cylinder to effect reduction of haulage speed.

5. A mineral mining machine having an electric motor, at least one cutter unit and a haulage mechanism for moving said machine, said cutter unit comprising at least one cutter element and a variable speed gear train interposed between said electric motor and said cutter element to drive the same, said haulage mechanism having an hydraulic motor, a source of hydraulic fluid, a pump for feeding said hydraulic fluid to said motor, and servo operated control means responsive to current flow in said electric motor for controlling the hydraulic pump output, and torque sensing means associated with said gear train to sense the torque transmitted by said gear train to drive the said cutter elements and to provide a signal when the torque transmitted by said gear train exceeds a predetermined level, said servo operated control means being response to said signal to control the hydraulic pump output and thereby effect reduction of the haulage speed.

6. The mineral mining machine as claimed in claim 5 in which said torque sensing device provides an electrical signal.

7. A mineral mining machine as claimed in claim 5 in which said torque sensing device is a mechanical torque transducer.

* * * * *